United States Patent [19]

Ivanov et al.

[11] 4,245,792

[45] Jan. 20, 1981

[54] DEVICE FOR FASTENING AN ARMOUR TO THE CRUSHING CONE OF A CRUSHER

[76] Inventors: Nikolai A. Ivanov, Novoizmailovsky prospekt, 19, kv. 196; Boris G. Ivanov, Basseinaya ulitsa, 5, kv. 8; Leonid P. Zarogatsky, Uglovoi pereulok, 5, kv. 21; Evgeny S. Mitrofanov, ulitsa Kibalchicha, 4, korpus 1, kv. 17; Vladimir A. Cherkassky, ulitsa Rudneva, 3, korpus 1, kv. 38, all of Leningrad, U.S.S.R.

[21] Appl. No.: 42,876

[22] Filed: May 29, 1979

[51] Int. Cl.[3] ..... B02C 2/04

[52] U.S. Cl. ..... 241/207

[58] Field of Search ..... 241/207-216

[56] References Cited

U.S. PATENT DOCUMENTS

| | | | |
|---|---|---|---|
| 525,410 | 9/1894 | Gates | 241/209 |
| 2,052,706 | 9/1936 | Guest | 241/208 X |
| 2,132,508 | 10/1938 | Campbell | 241/208 |
| 2,787,424 | 4/1957 | Lippmann | 241/216 |
| 2,881,981 | 4/1959 | Rumpel | 241/215 |

FOREIGN PATENT DOCUMENTS

| | | | |
|---|---|---|---|
| 304975 | 7/1971 | U.S.S.R. . | |
| 410808 | 5/1974 | U.S.S.R. . | |
| 507356 | 4/1976 | U.S.S.R. | 241/207 |

*Primary Examiner*—Howard N. Goldberg

*Attorney, Agent, or Firm*—Lackenbach, Lilling & Siegel

[57] ABSTRACT

The invention relates to a device for fastening an armour to the crushing cone of a crusher having an armour-clad outside cone and an armour-clad crushing cone mounted therein on a spherical support. The device comprises a pressure bush and a screw provided with a flange threaded into a bore in the central area of the crushing cone. The pressure bush is arranged in the upper end face of the armour-clad crushing cone and it is provided with projections. The flange is provided with threaded bores and slots to receive the projections of the pressure bush. The pressure bush is located under the flange with a clearance there between and said clearance being fixed with distance bolts threaded into the threaded bores of the flange and bearing against the pressure bush, thereby generating an interference between the thread of said screw and the bore of the crushing cone.

1 Claim, 3 Drawing Figures

DEVICE FOR FASTENING AN ARMOUR TO THE CRUSHING CONE OF A CRUSHER

FIELD OF THE INVENTION

The present invention relates to fine and intermediate crushers, and more specifically to devices for fastening an armour to the crushing cone of a crusher.

The present invention can be used to best advantage in the construction and mining industries.

BACKGROUND OF THE INVENTION

The fine and intermediate cone crushers which are now in use comprise an outside cone and a crushing cone disposed therein, with a crushing chamber formed therebetween. The crushing cone is mounted on a sperhical support which is secured, as is the outside cone, to the crusher bed. The crushing cone drive is provided with an unbalance means or eccentric. Mounted both on the both the outside and crushing cones are armours fashioned as detachable taper shells copying the shape of the respective cone. Due to considerable impact loads which occur in the crushing chamber, it is a device for fastening an armour to the crushing cone that is one of the most critical unit of a crusher.

Known in the art is a device for fastening an armour to the crushing cone of a crusher having an armour-clad outside cone and an armour-clad crushing cone mounted therewithin on a spherical support (cf. USSR Author's Certificate No. 410,808). The device comprises a pressure bush arranged on the upper end of the armour and shaped as a protective cap provided with lateral openings and it protects a nut disposed thereunder against failure. The nut provided with lateral openings is screwed on a threaded shank of the cone, whose end face is provided with a diametral slot. The pressure bush and the nut are locked against the shank of the cone with a taper pin fitted in the shank slot and in the lateral openings of the nut and bush.

In mounting the armour on the cone, the nut is screwed on its shank to a predetermined position with respect to the end face of the armour, until openings of the nut coincide with the diametral slot of the cone shank. The pressure bush is also mounted so as to align the openings with the openings of the nut and with the slot of the cone shank. The locking taper pin is driven in the aligned openings of the pressure bush and nut as well as the slot of the shank. The position of the nut in height is predetermined so as to ensure an interference fit of the armour after the pin is driven, and to align the nut openings with the slot of the cone shank.

When replacing the worm armour, the operations are carried out in reverse order.

However, because of the necessity to lock the nut only in a predetermined position with respect to the slot of the cone shank, it is impossible to provide a uniform and adequate initial interference fit of the armour. As the armour becomes worn out, the interference is impaired, which results in a failure of the fit surface of the cone and its subsequent malfunction.

Besides, the device is complex in design.

Known in the art is a device for fastening an armour to the crushing cone of a crusher having an armour-clad outside cone and an armour-clad crushing cone mounted therein on a spherical support (cf. USSR Author's Certificate No. 304,975, Int. cl. B02c 2/04). This device also comprises a pressure bush arranged on the upper end face of the armour and shaped as a cap to protect a nut disposed thereunder against a failure, the nut being provided with openings and is screwed on the threaded cone shank. The pressure bush and the nut are locked against each other with a taper pin. The device differs from the abovementioned device in that it has no diametral slot on the end face of the cone shank. In this case, the taper pin doesn't lock the pressure bush and nut against the cone, but locks the bush against the nut only. This enables self-tightening of the armour as its fit becomes loosened.

Assembling and disassembling of the device are carried out in the same manner as in the above-mentioned device.

The wear of the armour results in a decreased rigidity of its shell, thereby loosening the interference fit down to its complete elimination.

In operation, the loosened armour of the crushing cone gets a slight radial shift against the cone and the shift passes in succession around the periphery of the fit surface of the armour.

With such a shift, the armour comes into slow rotation relative to the crushing cone and, under the action of a rising frictional force, carries along the pressure bush or cap contacting with the end face thereof, and also through the pin, rotates the nut that exerts, while tightening, through the same pin and the bush, a new force action upon the armour, causing it to reliably together up to an interference fit. The self-tightening occurs regularly in course of the armour wear, which eliminates failure of the fit surface of the cone body.

However, due to the necessity for an exact alignment of the openings in the nut and bush to receive the pin, the device fails to provide a required interference fit of the armour.

While disassembling the device, the pin is knocked out to eliminate the interference in the thread joint. This is hindered by the friction force in the pin seat that has increased many-fold as compared with the assembly interference due to elastic or plastic deformation of the pin. All of this fails to provide a joint which is capable of being easily disassembled.

Also known in the art is a device for fastening an armour to the crushing cone of an inertial crusher having an armour-clad outside cone and an armour-clad crushing cone mounted therewithin on a spherical support (cf. USSR Author's Certificate No. 507,356). The device comprises a pressure bush arranged on the upper end face of the armour and a screw placed in a threaded opening in the central area of the cone, which screw is provided with a central opening and a flange provided with threaded openings to receive the bolts and with a slot to receive a projection of the pressure bush. The pressure bush is bolted to the flange of the screw and is equipped with a protective cap secured thereon.

When assembling the device, the screw with the pressure bush is screwed into the threaded opening of the cone and, upon the contact of the bush with the armour end face, it is tightened with a force sufficient to ensure a reliable interference of the armour with the fit surface of the cone. The protective cap is then secured on the bush.

This device enables a reliable initial interference fit of the armour. At the same time, the device in question operates at a decreased self-tightening of the armour.

There is no need for a knock treatment of the screw in order to release it and replace the worn armour. The interference in the thread of the screw is released by unscrewing the bolts coupling it with the bush. Having done this, the screw can be easily removed by hand.

However, since the allowable tensile strength values are lower than the compressive ones, it is necessary to increase significantly the diameter of the bolts, considering the strength condition while in tension. The increase of the bolts in diameter is limited by the overall dimensions of the device, which results in an unreliable operation of the device.

Besides, a non-parallelism of the armour end face and the flange plane, results in the parts of the device often being subjected to deformations when securing the armour and when its self-tightening, which hinders the disassembly of the device, and, in specific cases, makes it inoperative.

Furthermore, the device is a complex design.

SUMMARY OF THE INVENTION

It is an object of the present invention to increase the operative reliability of the device for fastening an armour to the crushing cone.

It is another object of the present invention to lower the labour-consumption while fastening and replacing the crushing cone armour.

It is still another object of the present invention to simplify the design of the device for fastening an armour to the crushing cone.

With these and other objects in view, there is proposed a device for fastening an armour to the crushing cone of a crusher having an armour-clad outside cone and an armour-clad crushing cone mounted therein on a spherical support. The device comprises a pressure bush provided with projections and arranged on the upper end face of the armour, and a screw placed in a threaded opening in the central area of the cone has a flange provided with threaded openings to receive distance bolts and slots to receive the projections of the pressure bush, wherein the pressure bush is mounted under the flange to provide a clearance there between, and the clearance is fixed by means of the distance bolts bearing against the pressure bush, thereby generating an interference between the thread of said screw and the bore of the crushing cone.

The advantage of the proposed device resides in that the pressure bush is self-aligned on the armour end face by the distance bolts, if its misalignment with respect to the flange of the screw occurs. The distance bolts therewith ensure a uniform interference fit of the armour on the cone. It is also advantageous that the clearance between the pressure bush and the flange of the screw enables, when replacing the armour, elimination of the interference in the screw thread by unscrewing the distance bolts by a little turn.

BRIEF DESCRIPTION OF THE ACCOMPANYING DRAWINGS

The present invention will now be described further by way of the preferred embodiment with reference to the accompanying drawings, in which.

DETAILED DESCRIPTION OF THE INVENTION

Figure 1:
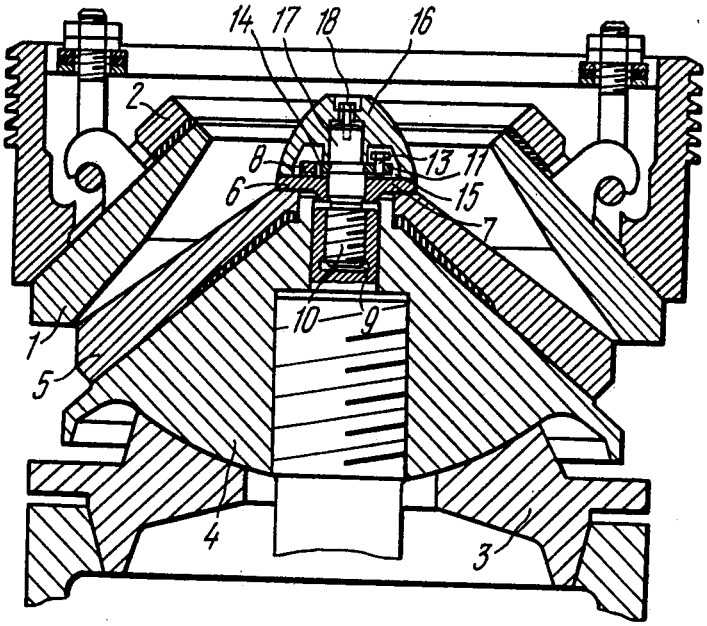
FIG. 1 is a longitudinal sectional view of the operative unit of a cone crusher wherein the device for fastening an armour to the crushing cone is made according to the invention.
Figure 2:
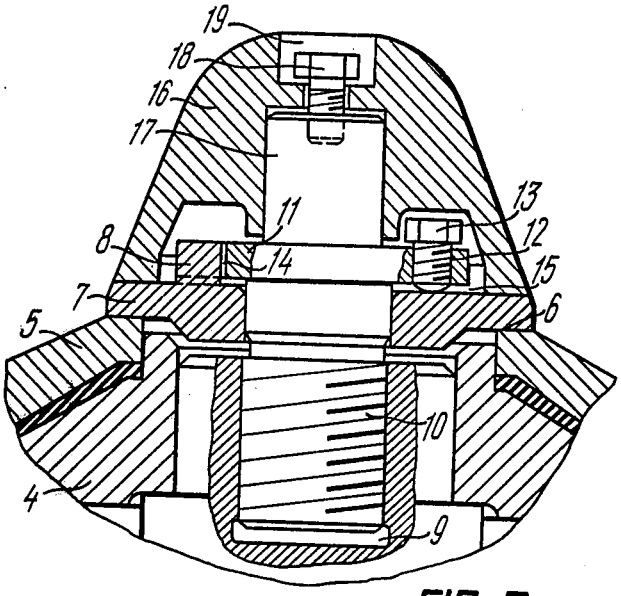
FIG. 2 is a fragmentary sectional view of a device for fastening an armour to the crushing cone of a crusher.
Figure 3:
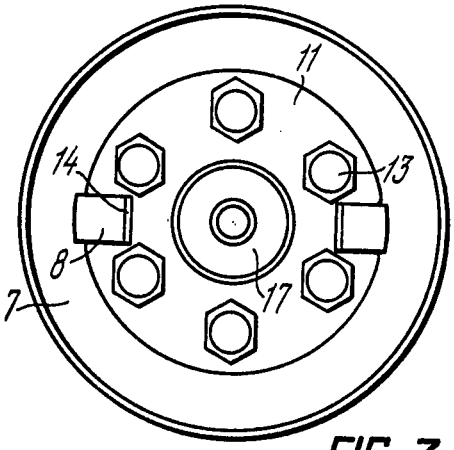
FIG. 3 is a plan view of a device for fastening an armour to the crushing cone, with the protective cap removed.

Referring to FIG. 1, the device for fastening an armour to the crushing cone of a crusher has an armour 1 covering an outside cone 2, inside of which, on a spherical support 3, is disposed a crushing cone 4 clad with an armour 5. Arranged on the upper end face 6 of the armour 5 (FIGS. 1, 2) is a pressure bush 7 provided with projections 8. Placed in a threaded bore 9 in the central area of the cone 4 is a screw 10 having a flange 11. The flange 11 is provided with threaded bores 12 in which are screwed distance bolts 13 (FIG. 3). Furthermore, provided in the flange 11 are slots 14 corresponding to the projections 8 of the pressure bush 7. The pressure bush 7 (FIG. 2) is arranged under the flange 11 with a clearance 15 therebetween.

Mounted on the upper end of the pressure bush 7 is a protective cap 16 arranged coaxially with a head 17 of the screw 10. The protective cap 16 is secured with a bolt 18, the head of which is seated within a boring 19.

The device for fastening an armour to the crushing cone operates as follows. Upon installation of the armour 5 on the crushing cone 4, the pressure bush 7 is placed on the upper end face of the armour. Then the screw 10 is screwed in to the threaded bore 9 until the projections 8 of the pressure bush 7 enter the slots 14 of the flange 11. The distance bolts 13 are then screwed into the threaded bores 12 of the flange 11 up to the stop at the upper end face of the pressure bush 7, the clearance 15 being provided between the flange 11 of the screw 10 and the pressure bush 7. The clearance depends on the elastic deformation of the armour 5 and the play of the threaded joint of the screw 10 with the opening 9 and the amount of interference generated between the thread of the screw 10 and the bore 9 of the crushing cone 4.

In the course of operation, the armour 5 of the crushing cone 4 becomes somewhat loosened, and hence, gets a slight radial shift relative to the cone 4. This shift passes in succession around the periphery of the fit surface of the armour 5. The armour 5 therewith comes into slow rotation with respect to the cone 4 and, with the action of a rising frictional force, carries along the pressure bush 7, which, in turn, rotates the screw 10 by means of the projections 8 mounted in the slots 14 of the flange 11 thus screwing the screw 10 into the threaded bore 9. The screw 10 acts through the bolts 13 upon the pressure bush 7 and, further, on the armour 5 which is self-tightened on the fit surface of the cone 4. The self-tightening is renewed with each loosening of the armour 5, thereby constantly maintaining the reliability of its fit on the cone 4.

To replace the worm armour 5, the bolt 18 is unscrewed, the protective cap 16 is removed, and the distance bolts 13 are loosened, thereby eliminating the interference in the thread of the screw 10 which goes downward as far as the clearance 15 will permit, the upper surface of the fillets of the screw thereupon are disengaged from the lower surfaces of the fillets of the threaded opening 9. The interference is thus eliminated, the screw 10 is easily removed, the pressure bush is then taken off and the worn armour 5 is dismantled.

According to the present invention, the inventive device for fastening an armour to the crushing cone provides increased reliability of fastening the armour;

decreased labour-consumption when fastening and replacing the armour; and a simplified design of the device.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

We claim:

1. A device for fastening an armour to the crushing cone of a crusher having an armour-clad outside cone and an armour-clad crushing cone, having a central area, mounted therein on a spherical support, comprising a threaded bore in the central area of said crushing cone, a screw in said threaded bore, a flange rigidly attached to said screw having threaded bores and slots, a pressure bush having projections engaging said slots of said flange and arranged under said flange with a clearance therebetween, and threaded fasteners in said threaded bores of said flange bearing against said pressure bush to fix the clearance between said pressure bush and said flange and generate an interference between the thread of said screw and said threaded bore of said crushing cone.

* * * * *